US006392469B1

(12) United States Patent
Padoan et al.

(10) Patent No.: US 6,392,469 B1
(45) Date of Patent: May 21, 2002

(54) STABLE REFERENCE VOLTAGE GENERATOR CIRCUIT

(75) Inventors: Silvia Padoan, Rimini; Carla Golla, Milan, both of (IT)

(73) Assignee: SGS-Thomson Microelectronics, S.r.l., Agrate Brianza (IT)

( * ) Notice: Subject to any disclaimer, the term of this patent is extended or adjusted under 35 U.S.C. 154(b) by 0 days.

(21) Appl. No.: 08/347,788

(22) Filed: Nov. 30, 1994

(30) Foreign Application Priority Data

Nov. 30, 1993 (EP) ..... 93830482

(51) Int. Cl.[7] ..... G05F 1/10
(52) U.S. Cl. ..... 327/538; 327/513
(58) Field of Search ..... 327/530, 534, 327/535, 536, 537, 538, 539, 540, 541, 542, 543, 512, 513, 546

(56) References Cited

U.S. PATENT DOCUMENTS 3,805,095 A * 4/1974 Lee et al. ..... 327/543
4,000,429 A * 12/1976 Yoshida et al. ..... 327/543
4,096,382 A * 6/1978 Numata et al. ..... 327/513
4,307,307 A * 12/1981 Parekh ..... 327/541
4,754,168 A * 6/1988 Liran ..... 327/536
4,843,265 A * 6/1989 Jiang ..... 327/538
4,914,316 A * 4/1990 Rossi et al. ..... 327/538
4,920,280 A * 4/1990 Cho et al. ..... 327/536
4,947,056 A * 8/1990 Jinbo ..... 327/538

OTHER PUBLICATIONS

Patent Abstracts of Japan, vol. 10, No. 127, (P–455 (2184) May 13, 1986, and JP–A–60 252 923 (Hitachi K.K.) Dec. 13, 1985.
Patent Abstracts of Japan vol.10 No. 111 (P–451) (2168) Apr. 25, 1986, and JP–A–60 243 717 (Hitachi K.K.).
Oguey et al., "MOS Voltage Reference Based on Polysilicon Gate Work Function Difference," IEEE Journal of Solid–State Circuits, vol. SC–15, No. 3, Jun. 1980, pp. 264–269.

* cited by examiner

*Primary Examiner*—Kenneth B. Wells
(74) *Attorney, Agent, or Firm*—Jenkens & Gilchrist, P.C.

(57) ABSTRACT

A circuit for generating a stable reference voltage (Vref) as temperature and process parameters vary, including at least one field-effect transistor (M1) and an associated resistive bias element (R) connected in series between a supply voltage (Vcc) and ground (GND), further includes a second field-effect transistor (M2) connected to the first transistor such that the reference voltage (Vref) can be picked up as the difference between the respective threshold voltages of the two transistors. This provides a reference voltage which is uniquely stable against variations in temperature and process parameters.

19 Claims, 8 Drawing Sheets

STABLE REFERENCE VOLTAGE GENERATOR CIRCUIT

CROSS-REFERENCE TO RELATED APPLICATION

This application claims priority from EPC App'n 93830482.1, filed Nov. 30 1993, which is hereby incorporated by reference. However, the content of the present application is not necessarily identical to that of the priority application.

BACKGROUND AND SUMMARY OF THE INVENTION

This invention relates to a circuit for generating a stable reference voltage. In particular, the invention relates to a circuit capable of providing a reference voltage which compensates for temperature and process parameters, and is highly stable with respect to the value of a supply voltage.

As is known, many types of electronic circuits require a reference voltage Vref which is stable over time. Several solutions have been proposed to derive, for example, such a reference voltage Vref from the supply voltage Vcc of the electronic circuit.

The simplest way of achieving this is, for example, to provide a resistive partition of the supply Vcc. In other words, it might suffice that a resistive divider be connected between a supply voltage pole and ground, with the reference voltage being picked up from a resistor linking node. But this solution is not devoid of serious problems:

- integrated circuit resistors are made to wide manufacturing tolerances, which does not allow their values to be known with any accuracy; this may result in producing a reference voltage which varies from the target voltage; and
- the integration of the resistors is not advantageous from the standpoint of circuit area occupation, which reflects unfavorably on integration costs.

In addition, the reference voltage may be affected by thermal drift from the circuit operating temperature and/or interferences with the supply voltage. An improved resistive divider can be implemented using a transistor-type of divider as shown in FIG. 1 herewith. A series of three MOS transistors can provide, for example, a reference voltage which is unaffected by temperature.

The last-mentioned solution would, however, have a drawback in that it produces a reference voltage which is closely dependent on the supply voltage Vcc. Furthermore, the latter voltage cannot amount to anything less than three times the threshold voltage of the MOS transistors, which rules out the use of circuits with low voltages.

Further prior approaches can only provide a stable reference voltage at the expense of increased circuit complexity; and even so, the reference voltage cannot be set in an accurate way. The underlying technical problem of this invention is, therefore, to provide a circuit arrangement which is uniquely simple and ensures an accurate and constant reference voltage as temperature and process parameters vary, while being quite stable with respect to the voltage supply.

An important idea which leads to the present invention is that of using a first, natural p-channel MOS transistor associated with a second, n-channel MOS transistor which is also a natural one; the reference voltage is obtained as the difference between the threshold voltages VT of these two transistors.

Based on this idea, the technical problem is solved by a circuit comprising two field-effect transistors of opposite type, connected in series between one supply voltage (e.g. ground) and a reference output node. A load element is connected to pull the node between the two transistors toward the other supply voltage. Preferably, an additional (and weaker) load element is provided to draw current through the first load element and second transistor. Thus, the reference voltage output is equal to the difference between the respective threshold voltages of the two transistors. This provides a reference voltage which is uniquely stable against variations in temperature and process parameters. The features and advantages of a circuit according to the invention will be apparent from the following description of an embodiment thereof, given by way of example and not of limitation with reference to the accompanying drawings.

BRIEF DESCRIPTION OF THE DRAWING

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

Figure 1:
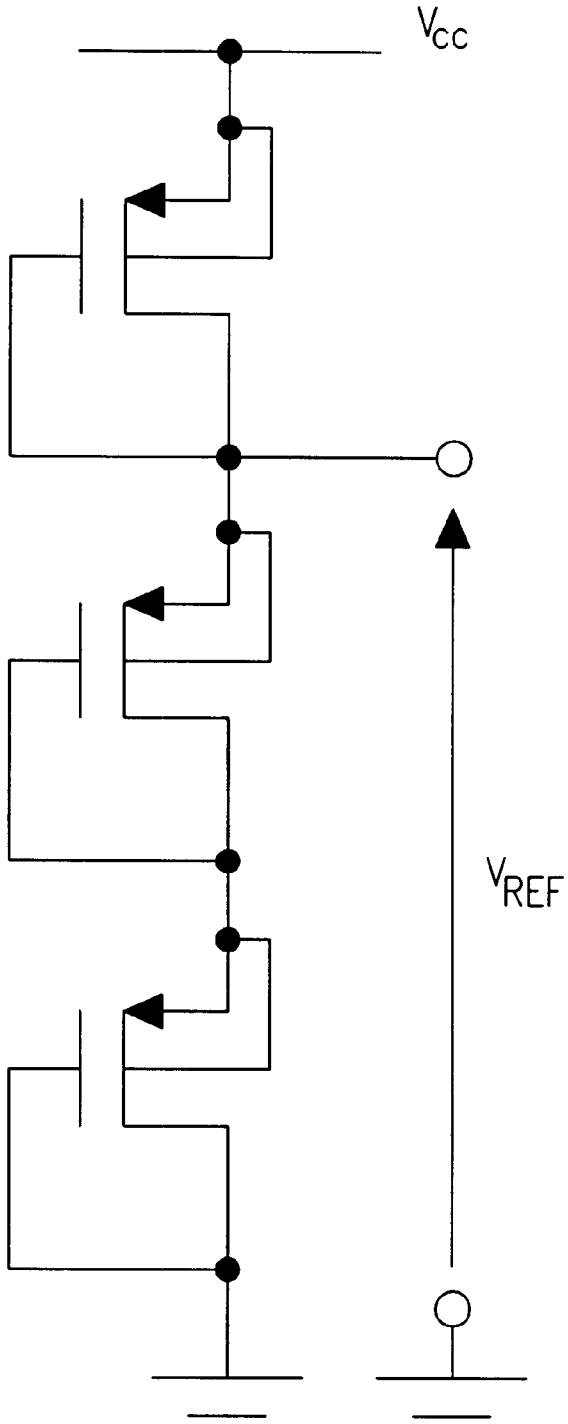
FIG. 1 (PRIOR ART)
FIG. 1 is a diagram showing schematically a reference voltage generating circuit according to the prior art.

The numerous innovative teachings of the present application will be described with particular reference to the presently preferred embodiment (by way of example, and not of limitation), in which:

With reference to the drawing FIGS, generally indicated at 1 is an electronic circuit for generating a stable reference voltage, which can function as an input of a comparator 2. The circuit 1 allows a reference voltage, denoted by Vref, to be obtained from a voltage supply Vcc.

More particularly, the circuit 1 is connected between the voltage supply Vcc and ground GND, and comprises a bias resistor R, a first transistor M1, and a second transistor M2.

The resistor R may be replaced with a bias MOS transistor of the p-channel type having its gate electrode grounded; this being a preferable circuit embodiment with integrated circuits.

The transistors M1 and M2 are field-effect transistors of the MOS type. Each of them has a first or drain terminal D, a second or source terminal S, and a control gate terminal G.

The first transistor M1 is a natural p-channel MOS, and the second transistor M2 is a natural n-channel MOS. In the presently preferred embodiment, M1 has dimensions of 30 $\mu$m/1.3 $\mu$m, and M2 has dimensions of 30/1.5, but of course these dimensions can be varied. In the presently preferred embodiment, an NMOS enable transistor is interposed between M1 and ground. The load element R is provided by an N well-resistor 50/2 NMOS depletion load. A very weak pull-down, on node S2, is provided by an NMOS transistor, gated by node D2, and having dimensions of 2/100.

Transistors of the so-called "natural" type have an advantage in that their threshold voltages are related in an analogous manner to temperature and/or process parameters. Accordingly, the difference between their threshold voltages will be kept constant as such parameters vary.

In addition, both transistors M1 and M2 are connected in the circuit 1 in a diode configuration, that is with their respective gate and drain terminals connected together. Specifically, the gate terminal G1 of transistor M1 is shorted to the drain terminal D1, while the gate terminal G2 of the second transistor M2 is shorted to the drain terminal D2.

The first transistor M1 has its source terminal S1 connected to the bias resistor R and its drain terminal D1 connected to ground at GND. The other end of the bias resistor R is connected to the voltage supply Vcc.

The source terminal S1 is in common with the drain terminal D2 of the second transistor M2. The other source terminal S2, of transistor M2, is the point whence the desired reference voltage Vref is picked up.

With this arrangement, the voltage at the source terminal S2 of transistor M2 is equal to the difference between the threshold voltage $VT_{p\text{-}nat}$ of transistor M1 and the threshold voltage $VT_{n\text{-}nat}$ of transistor M2. A pull-down load is provided on node S2, to provide a leakage toward ground.

Assuming, for example, the threshold voltage of a natural p-channel transistor to be about 1.7 V ($VT_{p\text{-}nat}$=1.7 V), and the threshold voltage of a natural n-channel transistor to be about 0.6 V ($VT_{n\text{-}nat}$=0.6 V), then the value of the reference voltage Vref (given as $Vref=VT_{p\text{-}nat}-VT_{n\text{-}nat}$ would be approximately 1.1 V.

Temperature and process parameter variations would change the threshold voltages of the transistors in the same direction (to increase or decrease them), and cancel out when their difference is taken. The resultant reference voltage will, therefore, be unaffected by temperature and process parameters.

Figure 4A:
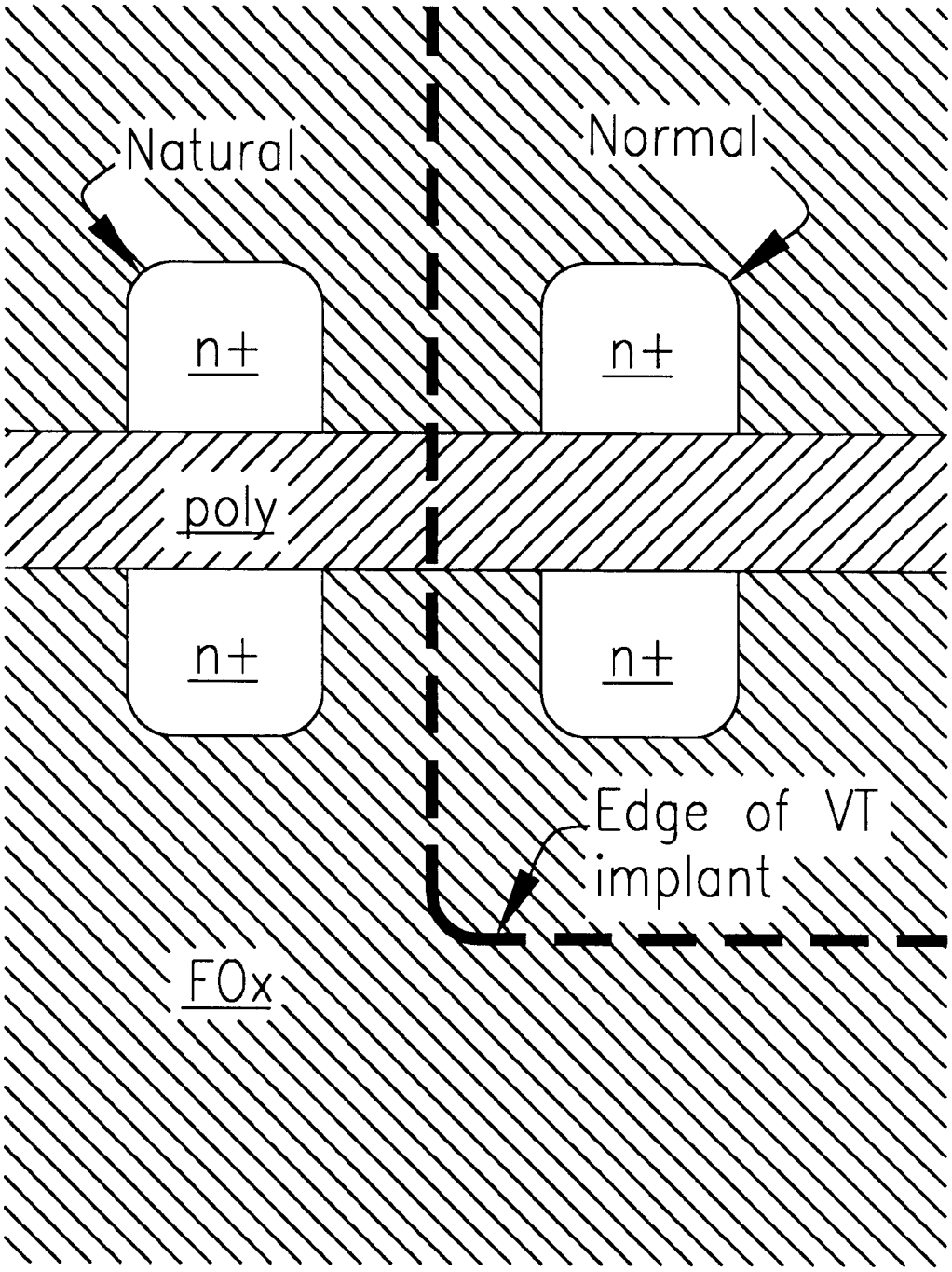
FIGS. 4A and 4B schematically show the mask differences which distinguish natural transistors from normal, transistors.
Figure 4B:
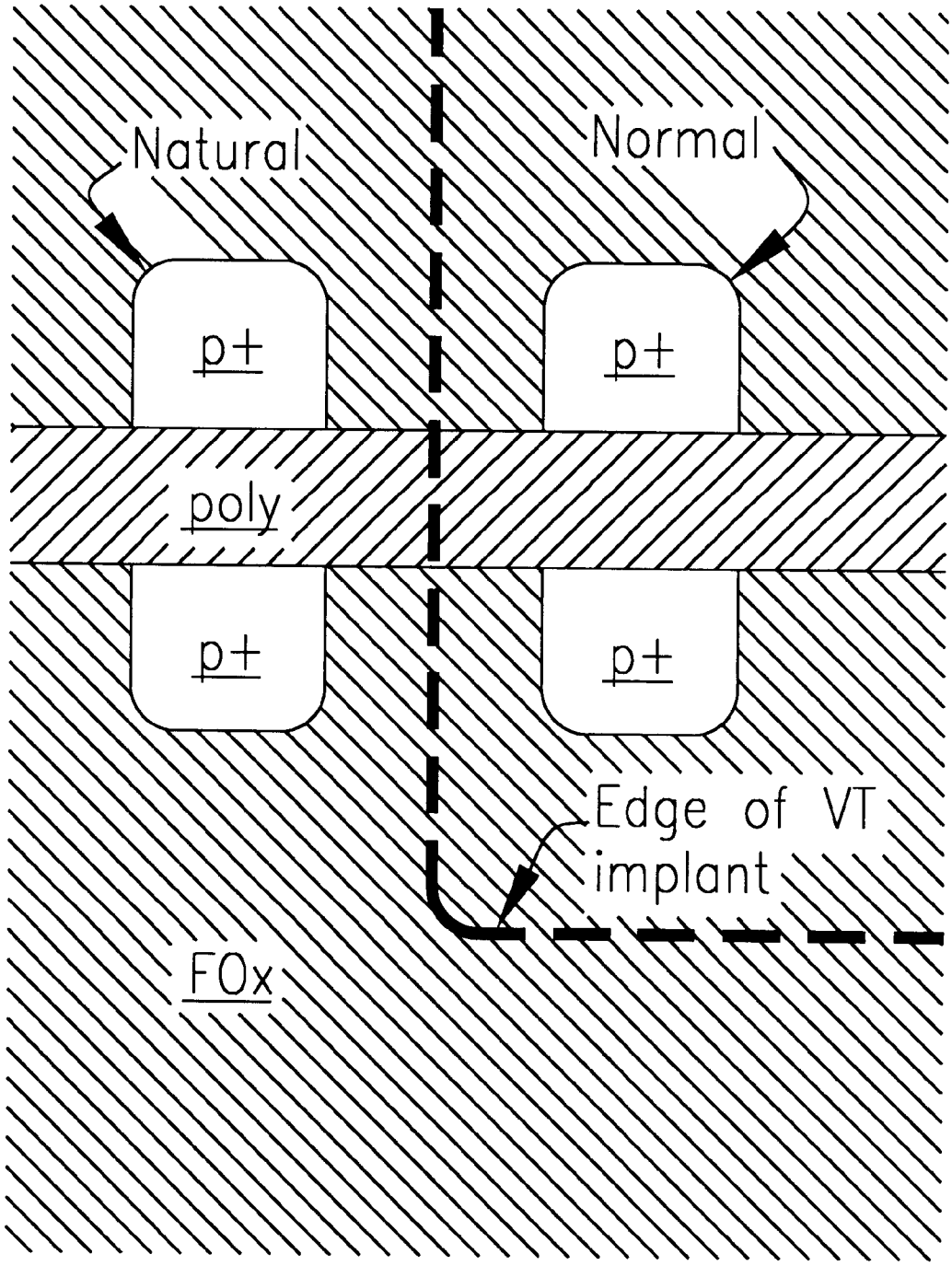

FIGS. 4A and 4B schematically show the mask differences which distinguish natural transistors from normal transistors. A transistor is formed wherever poly crosses active (i.e. locations where the field oxide FOx is absent). In a CMOS process, the source/drain implants are masked, so that the NMOS transistors have n+source/drain regions in exposed active (i.e. wherever active is not covered by poly), and the PMOS transistors have p+source/drain regions in exposed active areas. The VT implants are preferably patterned, to adjust VTN and VTP to desired target values (typically in the neighborhood of +1 V and −1 V in modern processes, but sometimes e.g. ±0.8 V or ±1.2 V, depending on the requirements of power consumption etc.). Transistors which are not exposed to a VT-adjust implant are called "natural" (or "native") transistors.

A reference voltage obtained by simulation within a broad range of temperatures (−40° C. to +150° C.) has revealed a Gaussian distribution centered on the desired value of 1.1 V, with very little scattered around it, which was the objective of the invention and obviates the problems of conventional circuits. In a sample specific embodiment, values were found (by simulation) to be 1.04 V at −40° C., 1.07 V at 27° C., and 1.11 V at 85° C.

Of course these results are not necessarily the best possible with the invention; they are provided merely to give an example of the superiority of the invention over the prior art.

Figure 2:
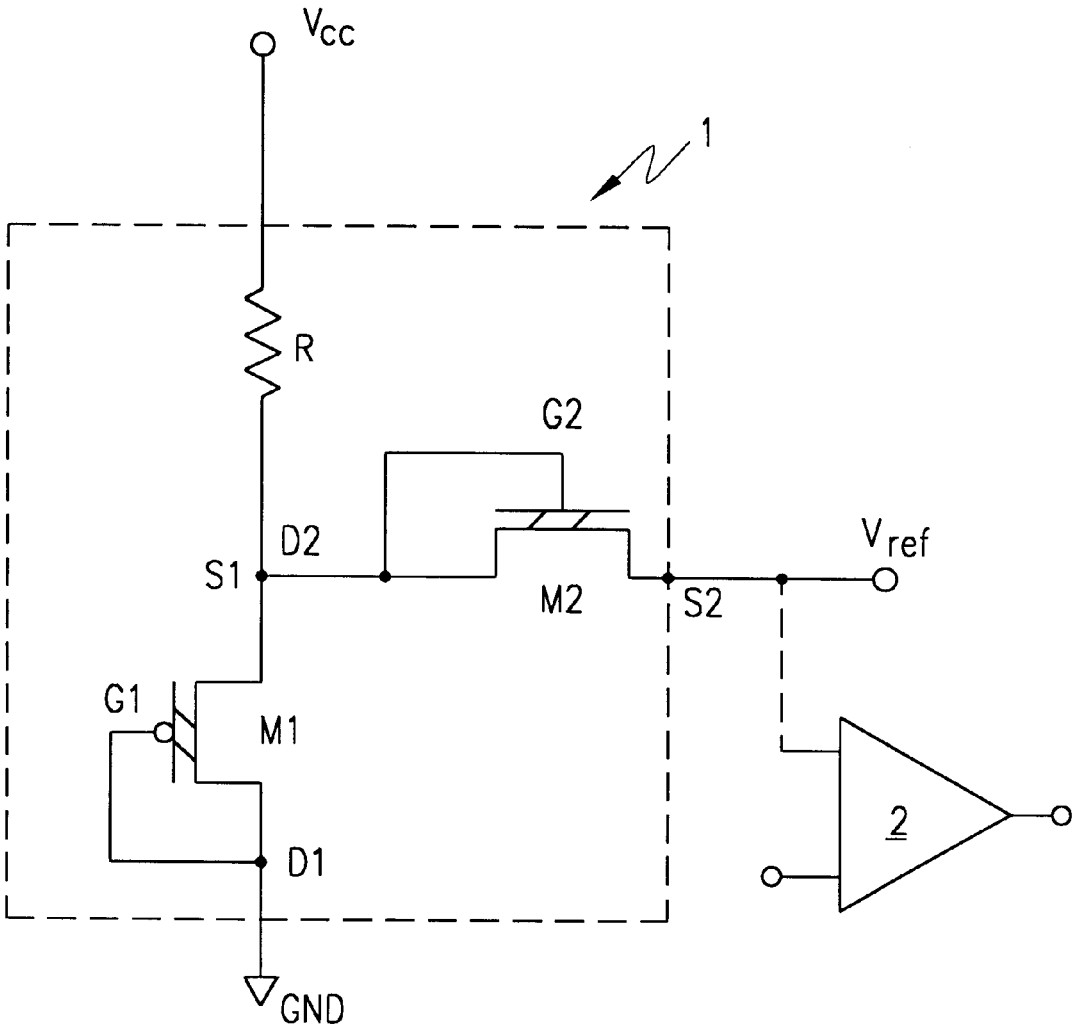
FIG. 2 is a diagram showing the circuit of this invention.
Figure 3A:
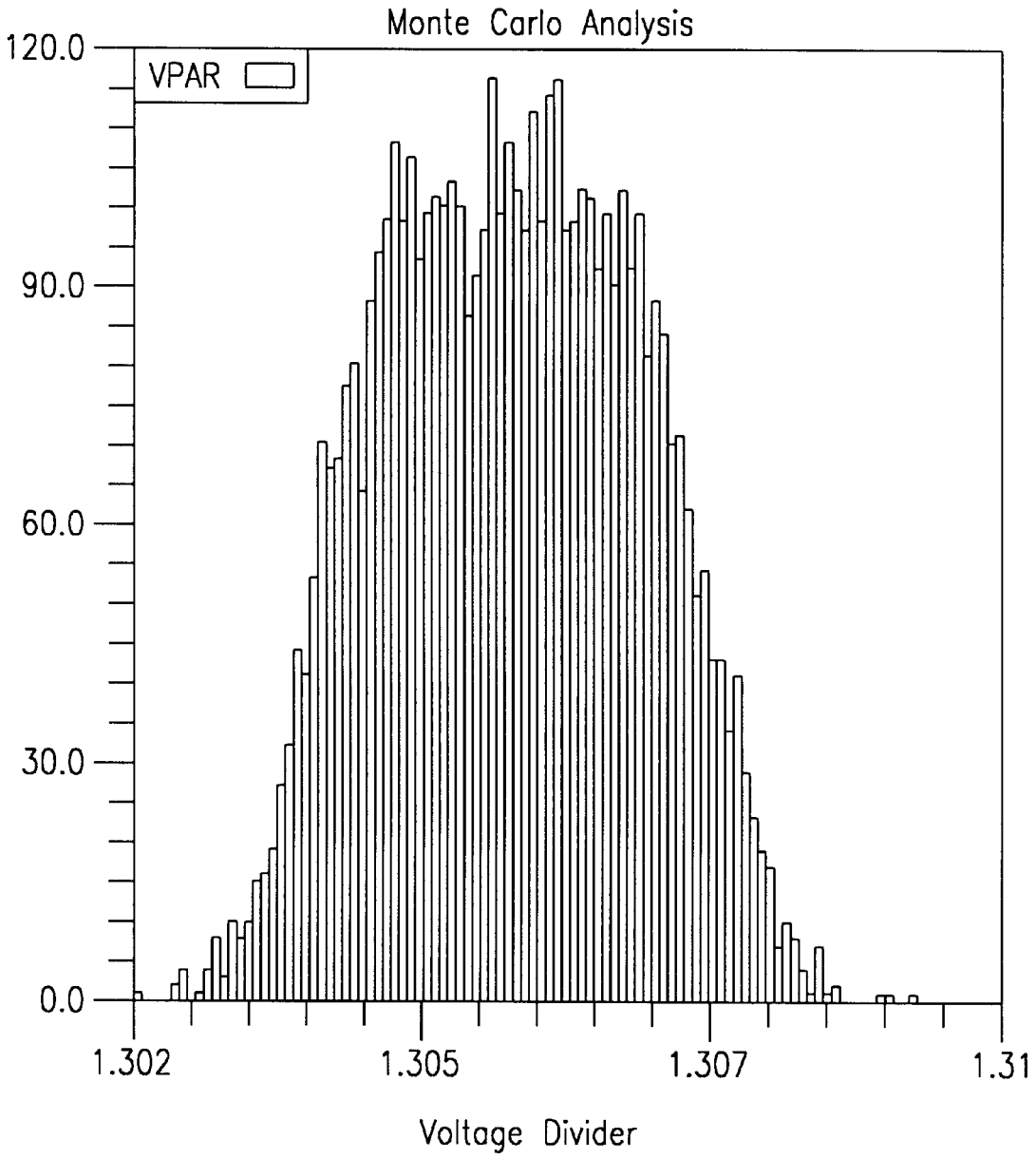
FIG. 3A (PRIOR ART)
FIGS. 3A–3D show the results of MonteCarlo simulations analyzing the sensitivity of a prior art resistive divider (FIGS. 3A–3B) and of the circuit of FIG. 2 (FIGS. 3C–3D)
Figure 3B:
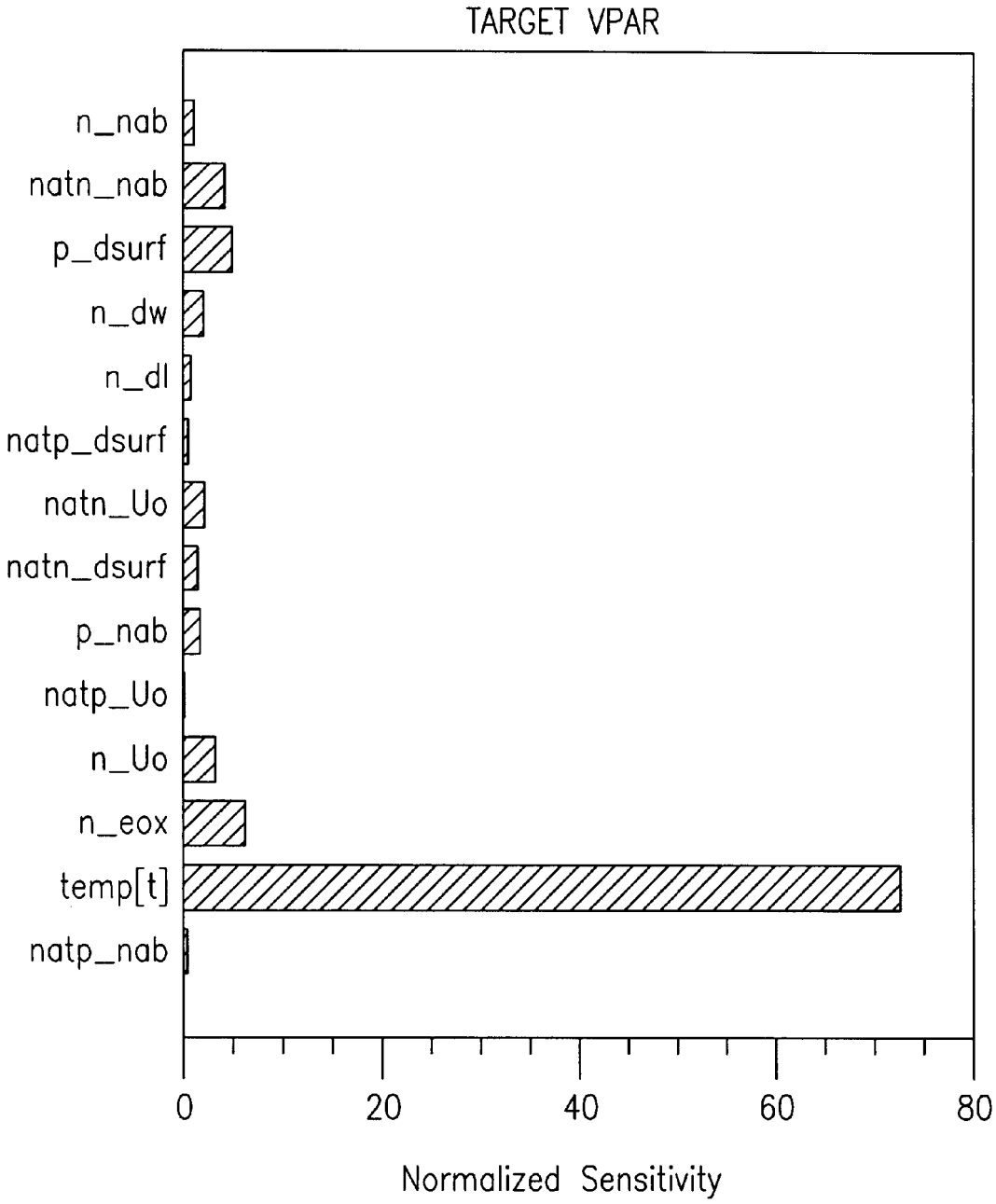
FIG. 3B (PRIOR ART)
Figure 3C:
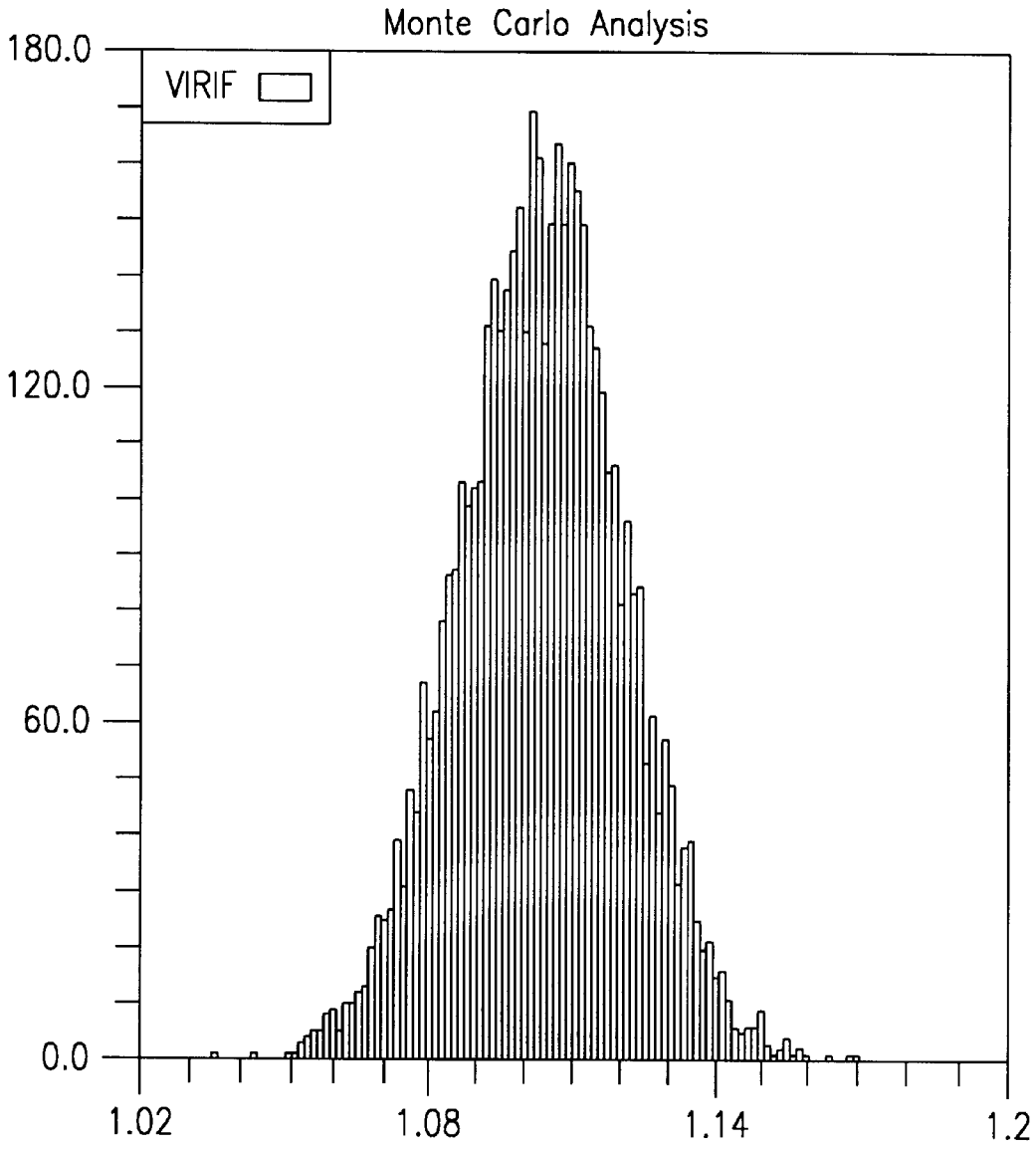
Figure 3D:
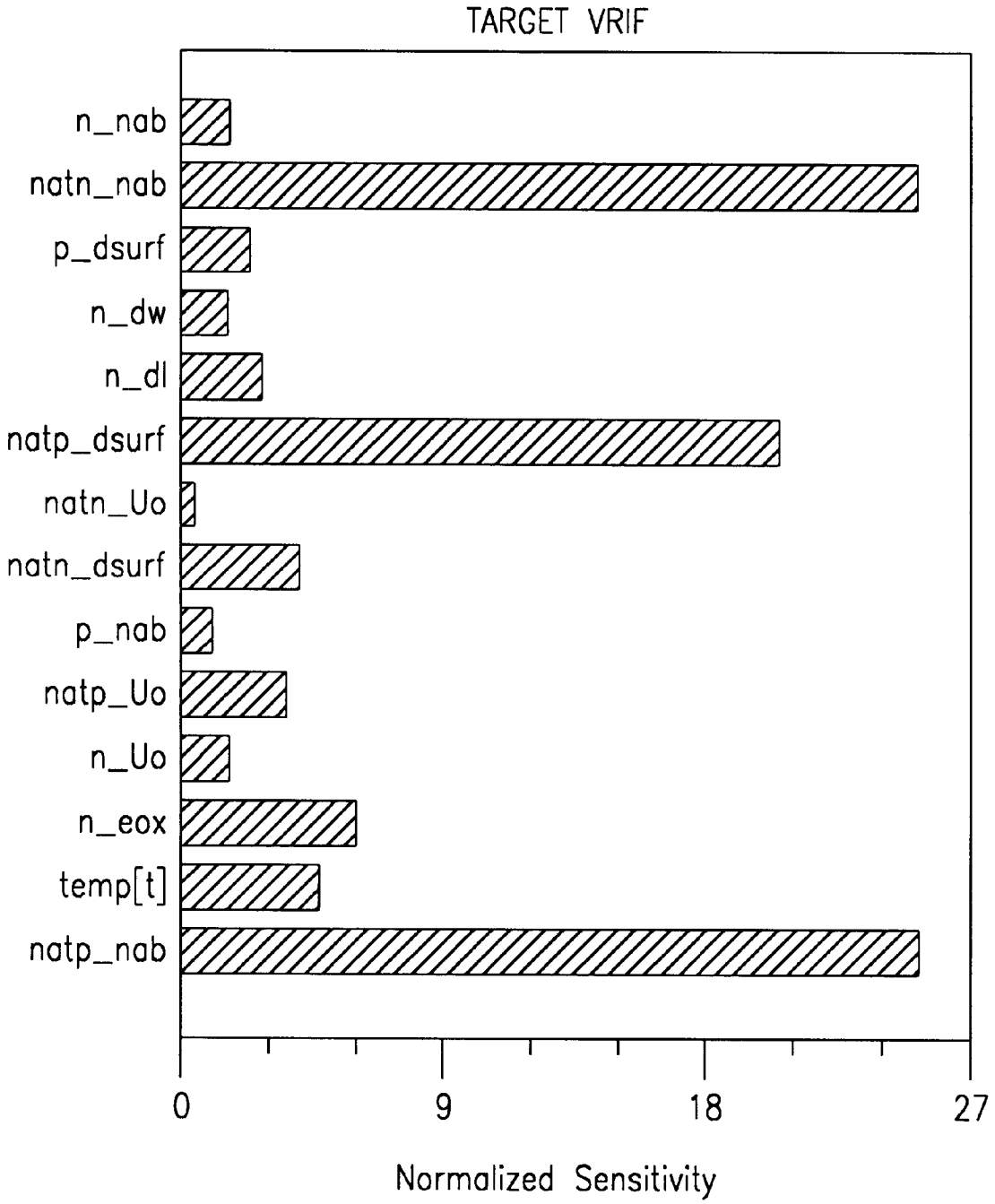

FIGS. 3A–3D show the results of MonteCarlo simulations analyzing the sensitivity of a prior art resistive divider (FIGS. 3A–3B) and of the circuit of FIG. 2 (FIGS. 3C–3D). FIGS. 3A and 3C show the distribution of output voltages obtained by varying various parameters within their normal ranges, and FIGS. 3B and 3D show corresponding analyses of sensitivity to various parameters. Note, in particular, that the conventional circuit is very sensitive to temperature, but the innovative circuit is not. (In the list of process parameters, "nab" is the doping level of the implanted region; "dsurf" is the interface implanted dose; "dw" is variation from the drawn electrical width; "dw" is variation from the drawn electrical length; "uo" is the zero field carrier mobility at 25° C.; and "eox" is the oxide thickness. In this analysis, the threshold voltage of the normal NMOS devices was assumed to be 1V, and that of the normal PMOS devices was assumed to be −1V. The threshold voltage of the natural NMOS devices ("natn") was assumed to be 0.6V, and that of the natural PMOS devices was assumed to be −1.7V.

The circuit arrangement of this invention is very simple, but quite effective. This stable reference voltage generator circuit may be used, for example, in the low Vcc threshold detector in a 4M bit flash memory. An example of a low Vcc threshold detector in which the claimed circuit can advantageously be used is described in European application EP93830537.2 (which is hereby incorporated by reference). Alternatively this circuit may be used on other threshold detectors, such as the one disclosed in the U.S. Pat. No. 4,975,883 ("Method and apparatus for preventing the erasure and programming of a nonvolatile memory"), which is hereby incorporated by reference.

As will be recognized by those skilled in the art, the innovative concepts described in the present application can be modified and varied over a tremendous range of applications, and accordingly the scope of patented subject matter is not limited by any of the specific exemplary teachings given.

For example, as will be obvious to those of ordinary skill in the art, other circuit elements can be added to, or substituted into, the specific circuit topologies shown.

For another example, the load element need not be a pure resistor, but can alternatively be a depletion transistor or similar resistive device.

What is claimed is:

1. A circuit comprising:

a first diode-connected natural field effect transistor connected, in series with a load element, between first and second power supply connections; said first transistor and said load element having an intermediate node therebetween;

a second diode-connected natural field effect transistor connected between said intermediate node and an output node;

wherein said first and second transistors are of opposite conductivity types, and said first transistor has a threshold voltage whose absolute value is more than the absolute value of the threshold voltage of said second transistor;

whereby said output terminal provides a voltage which is equal to the threshold voltage of said first transistor reduced by the absolute value of the threshold voltage of said second transistor.

2. The circuit of claim 1, wherein said first transistor has a threshold voltage whose absolute value is more than twice the absolute value of the threshold voltage of said second transistor.

3. The circuit of claim 1, wherein said first field effect transistor is a P-channel field effect transistor, and said first power supply is a positive power supply.

4. The circuit of claim 1, wherein said load is a transistor having a gate connected to a constant voltage.

5. The circuit of claim 1, further comprising an additional load element operatively connected at said output node to continually draw current through said second transistor.

6. An integrated circuit comprising:

a diode-connected natural P-channel field effect transistor connected between a chip ground and an intermediate node;

a load connected between said intermediate node and a positive power supply connection; and a diode-connected natural N-channel field effect transistor connected between said intermediate node and an output node;

wherein said P-channel transistor has a threshold voltage whose absolute value is more than the absolute value of the threshold voltage of said N-channel transistor;

whereby said output node provides a reference voltage above chip ground which is equal to the threshold voltage of said P-channel transistor reduced by the absolute value of the threshold voltage of said N-channel transistor.

7. The integrated circuit of claim 6, further comprising an additional load element operatively connected at said output node to continually draw current through said N-channel transistor.

8. The integrated circuit of claim 6, wherein said P-channel field effect transistor has a threshold value whose absolute value is more than twice the absolute value of the threshold voltage of said N-channel field effect transistor.

9. The integrated circuit of claim 6, wherein said load is a resistor.

10. A CMOS integrated circuit, comprising:

logic circuitry including both P-channel and N-channel field effect transistors; said N-channel logic transistors each including a vertical doping profile, in respective channel regions thereof, which includes a surface doping concentration corresponding to a VT-adjust implant; and said P-channel logic transistors each including a vertical doping profile, in respective channel regions thereof, which includes a surface doping concentration corresponding to a VT-adjust implant; and a reference voltage circuit which includes a diode-connected P-channel field effect transistor connected between a chip ground and an intermediate node;

a load connected between said intermediate node and a positive power supply connection; and a diode-connected N-channel field effect transistor connected between said intermediate node and an output node;

whereby said output node provides a reference voltage above chip ground which is equal to the threshold voltage of said PMOS transistor reduced by the absolute value of the threshold voltage of said N-channel transistor;

wherein said P-channel and N-channel transistors of said reference voltage circuit do not include any dopant concentration in the respective channels thereof corresponding to said VT-adjust implant.

11. The integrated circuit of claim 10, wherein said load is a resistor.

12. The integrated circuit of claim 10, further comprising an additional load element operatively connected at said output node to continually draw current through said N-channel transistor.

13. The integrated circuit of claim 10, further comprising a differential amplifier connected at said output node to receive the voltage from said output connection and to receive a second voltage, and to provide a differential feedback signal which is dependent on the difference between said the voltage from said output connection and said second voltage.

14. A circuit for generating a stable reference voltage as temperature and process parameters vary, comprising:

at least one natural field-effect transistor and an associated resistive bias element connected in series between a supply voltage and ground, and a second natural field-effect transistor interposed between the first transistor and an output node, and not directly connected to said supply voltage nor to ground, such that said reference voltage can be picked up as the difference between the respective threshold voltages of the transistors.

15. A circuit according to claim 14, wherein the second of said transistors is a natural n-channel MOS.

16. A circuit according to claim 14, wherein both said transistors are connected in the circuit in a diode configuration with their respective gate and drain terminals connected together.

17. A circuit according to claim 14, wherein the second transistor has at least one terminal in common with the first transistor.

18. A circuit according to claim 17, wherein said common terminals are the source of the first transistor and the drain of the second transistor, respectively.

19. A circuit according to claim 17, wherein the second transistor has its drain terminal connected to the resistive element and its source terminal available for picking up the reference voltage.

* * * * *

UNITED STATES PATENT AND TRADEMARK OFFICE

CERTIFICATE OF CORRECTION

PATENT NO. : 6,392,469 B1
DATED : May 21, 2002
INVENTOR(S) : Silvia Padoan et al.

It is certified that error appears in the above-identified patent and that said Letters Patent is hereby corrected as shown below:

Column 1,
Lines 7-8, replace "1993", which is hereby incorporated by reference." with -- 1993. --

Column 2,
Line 31, replace "from normal," with -- from normal --
Line 46, replace "Vcc and ground" with -- Vcc and a ground --

Signed and Sealed this

Sixteenth Day of September, 2003

JAMES E. ROGAN
*Director of the United States Patent and Trademark Office*